United States Patent [19]

Kinley et al.

[11] Patent Number: 4,557,327

[45] Date of Patent: Dec. 10, 1985

[54] ROLLER ARM CENTRALIZER

[75] Inventors: Karl S. Kinley, Houston; Allyn R. Pratt, Sugarland, both of Tex.

[73] Assignee: J. C. Kinley Company, Houston, Tex.

[21] Appl. No.: 531,228

[22] Filed: Sep. 12, 1983

[51] Int. Cl.[4] ..... E21B 17/10

[52] U.S. Cl. ..... 166/241; 166/172; 175/325; 308/4 A

[58] Field of Search ..... 166/241, 172, 174, 176; 175/325; 308/4 R, 4 A, 6 A

[56] References Cited

U.S. PATENT DOCUMENTS

| | | | |
|---|---|---|---|
| 1,898,074 | 2/1933 | Bailey | 308/6 A |
| 2,490,350 | 12/1949 | Grable | 166/4 |
| 3,052,302 | 9/1962 | Lagucki | 166/153 |
| 3,070,167 | 12/1962 | Loy, III et al. | 166/153 |
| 3,343,608 | 9/1967 | Solum | 166/241 |
| 3,555,689 | 12/1968 | Cubberly, Jr. | 33/178 |
| 3,977,468 | 8/1976 | Brewer et al. | 166/241 |
| 3,978,924 | 9/1976 | Roesner | 166/241 |
| 4,243,099 | 1/1981 | Rodgers, Jr. | 166/241 X |

FOREIGN PATENT DOCUMENTS

| | | | |
|---|---|---|---|
| 605947 | 10/1978 | U.S.S.R. | 166/241 |

*Primary Examiner*—Stephen J. Novosad
*Assistant Examiner*—M. Goodwin
*Attorney, Agent, or Firm*—Pravel, Gambrell, Hewitt & Kimball

[57] ABSTRACT

A roller arm centralizer to center a drill string in a well pipe. The arms of the roller arm centralizer include shoulders to limit movement of the arms in the direction of the centralizer body which prevents the arms from being locked in a straight line adjacent to the centralizer body. The shoulders also prevent the arms from being forced into an undesired configuration; wherein one arm is parallel to the body and the other two arms form a "V", by an abrupt decrease in the bore diameter. The roller arm centralizer remains operative when passing through relatively narrow sections of well pipe or through well pipe having abrupt changes in diameter.

8 Claims, 6 Drawing Figures

2
12b
12
14
25
24
A
26
32
40
30
38
36
34
34
40
32
26
151b
17
151
155
153
151a
14
156
152a
157
152
18
2

12c
12
12a
14
10a
25
24
3
44
3
10
26
29
32a
51
51
46
49
32
41
32
41
42
A
39
38
30
28
38
42
38
30
39
42
41
49
46
51
32
32
32a
29
26
44
151b
151
10b
17
19
155
151a
153
154
15
156
157
152a
152
18

ROLLER ARM CENTRALIZER

FIELD OF THE INVENTION

The present invention relates to a roller arm centralizer to center a tool in a well pipe.

DESCRIPTION OF THE PRIOR ART

In drilling and testing operations in a well bore or well pipe, it is desirable to center the drill string in the well pipe.

U.S. Pat. No. 2,490,350 taught the use of a centering device that used a plurality of two segment arms that were normally in a retracted position along the device and centered the drill string within the bore when activated from the surface. U.S. Pat. No. 4,243,099 taught a device for centering a tool in a well bore wherein a plurality of arm members were extended to contact the well bore, and thereby center the device, by means of a reversable electric motor controlled from the surface. U.S. Pat. No. 3,555,689 taught a centralizing device wherein a plurality of arched springs contacted the well bore to center the drill string and a plurality of interconnected arms prevented singular movement of one spring. U.S. Pat. No. 3,977,468 taught a well bore centering device that used a number of interconnected sensing arms with springs to center the apparatus as well as measure and record changes in the well bore diameter. U.S. Pat. No. 3,978,924 taught a drill string centralizer that used bow springs attached to mechanical arms to maintain contact with the bore hole wall.

The centralizers of the prior art are limited in the usefulness in that the use of bow springs to contact the bore hole wall or the tubing results in a dangerous wear condition. As a bow spring wears out, it makes for a very sharp edge that creates handling problems for the operators when they try to remove it from the hole. If a bow spring should wear out and break in the hole, it will almost certainly stick itself in the hole and cause considerable problems during the removal process.

The centralizers that use a rigid arm with a wheel on the end are limited in that sudden, short recesses, such as tubing collars and tools in a tubing string, cause their small contact points to hang up and either stick the tool string in the hole or create a jerking action which can violently shake the tool string and ruin the accuracy of a caliper survey. For these reasons, in the prior art, a surface controlled motor has often been used to retract the arms or to reduce the arm centralizing pressure when the tool must travel through tubing.

The centralizer that uses a bow spring as in U.S. Pat. Nos. 3,978,924 and 3,977,468 are limited in several ways. To have a hidden spring flexible enough to allow the 30° to 35° mentioned in U.S. Pat. No. 3,978,924, the spring will also have to be quite thin and therefore provide only a small force. The weaker the force provided by this hidden spring, the more danger there is of the arms being locked against the body of the tool. Also, with the arm design shown in FIGS. 2 and 3 of U.S. Pat. No. 3,978,924, there is a danger of the linkage forming a locked condition upon re-entering the tubing string or otherwise engaging any other sharp restriction.

The centralizers of the prior art are limited in their usefulness in that when they are run through a narrower portion of a pipe, the spring means may become deformed or the mechanical arms may become locked in a position essentially adjacent to the apparatus body. In such case, the centering arms might no longer be forced out into contact with the pipe wall and the desired centering of the string would not be accomplished.

SUMMARY OF THE INVENTION

The present invention relates to a new and improved roller arm centralizer apparatus in which a tool is centered in a well pipe even when the pipe diameter varies widely.

It is an object of the present invention to provide a well pipe centering device that will not catch or hang up in sudden or sharp restrictions in the pipe, or upon re-entering the pipe from open hole below the pipe.

It is also an object to provide a centering device which is shorter by virtue of having an increased arm angle capability.

The apparatus comprises an eiongated body with provision at one end to attach to a wire line and provision at the other end to attach to a well tool such as a caliper tool. Attached to the body are two stationary collars. Equally spaced around the body and attached to the body by movable collars are three centering arms. Each centering arm is made up of a center roller arm segment and two connector segments. At the pivot point where the end segments are attached to the center roller arm segment is a means to limit movement of the segments in the direction of the body. Such means also prevents the segments from becoming forced from the desired "open U" configuration into an undesired configuration, wherein one end segment is parallel to the body and the center and other end segments form a "V", by an abrupt decrease in the bore diameter.

The centering arms are forced laterally outwardly by coil springs mounted between the stationary and movable collars. Mounted on each end segment is an arch spring to further urge each centering arm outwardly to prevent locking of the centering arms in alignment with the body.

DESCRIPTION OF THE PREFERRED EMBODIMENT

Figure 1A:
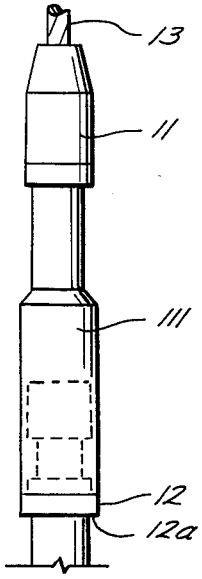
FIG. 1*a* is a plan view of the present invention showing a wireline attachment.
Figure 5:
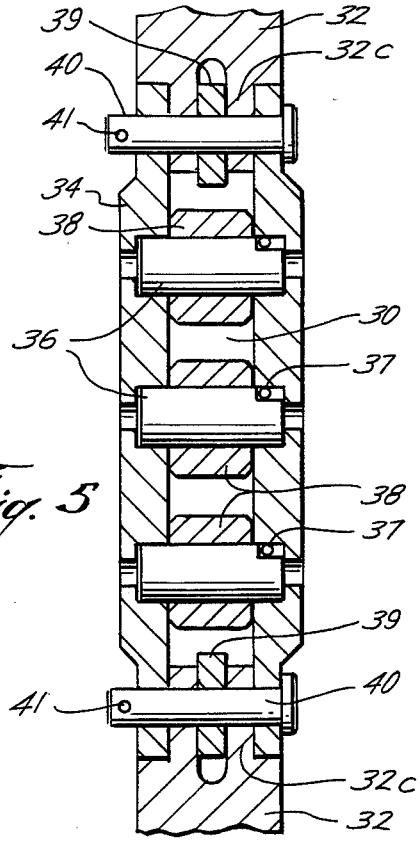
FIG. 5 is a cross-sectional view of a roller arm segment along line 5—5 of FIG. 4.
Figure 4:
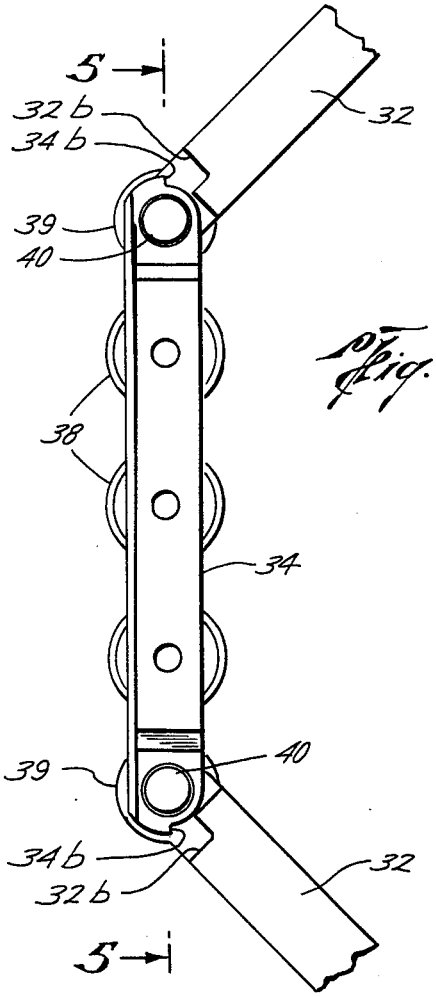
FIG. 4 is a cross-sectional view of a roller arm segment.

The apparatus A consists of a rigid body 10 having an upper end 10*a* to which is attached a connector 12 by a locking pin 14. The connector 12 has a conventional fishing neck 12*a*. The upper end of the connector 12 has a slot 12*b* and shoulders 12*c* to interlock with an adapter 111 which is threadably connected to a wire line socket member 11 which has a wireline 13 secured thereto in any known manner (FIG. 1A). The lower end 10*b* of the body 10 is threaded to receive a caliper adapter 15. The lower end 10*b* of body 10 has two slots 17, at right angles, so that a locking pin 19 may be inserted through one of the slots 17 and a collar 151 on the adapter 15 to prevent unthreading of the caliper adapter 15.

The caliper adapter 15 preferably has a swivel caliper adapter, commonly called a universal joint, which includes collar 151 having a threaded bore to receive threads on the lower end 10*b* of the body 10 and an open lower end 151*a* of a "U" configuration. A second swivel part 152 has an open upper end 152*a* of a "U" configuration. A third swivel part 153 is pivotally mounted within the open "U" of the collar 151 by pivot pin 154. Pivot pin 154 is locked in place by locking pin 155. The open "U" of the second swivel part 152 is pivotally mounted to the lower part of the center part 153 by pivot pin 156, such that the "U" of the collar 151 is at right angles and interconnects with the "U" of the second part 152. Pivot pin 156 is locked in place by locking pin 157. The upper end of a caliper tool 18 (partially shown) is connected to the lower end of the caliper adapter part 152. The upper surface 151*b* of collar 151 is at the lower end of body 10 for a purpose to be hereinafter described.

A stationary collar 24 is threadably attached to the upper end 10*a* of the body 10. The stationary collar 24 is locked in position by locking collar 25 which is also threadably mounted on body 10 such that it can abut collar 24 thereby locking collar 24 in position. Around the body 10 between the stationary collars 24 and 151 are two movable collars 26. The movable collars 26 serve to space three centering arms 28 around the body. Each of the centering arms 28 is made up of a center roller bar segment 30 and two end segments 32. The end segments 32 are pivotably connected by pivot pins 29 to the movable collars 26 and the roller bar segments 30.

The roller bar segments comprise a pair of bars 34 and a plurality of rollers 38 and 39. End rollers 39, which protect the pivot point as the well pipe diameter changes, are mounted on clevis pins 40 retained by cotter pins 41 at the pivot points between the roller arm segment 30 and the end segments 32. End segments 32 have a clevis configuration 32*c* and rollers 39 are mounted in the center of the clevis with bars 34 pivotally mounted to the outside of the clevis. Rollers 38 are mounted on hardened dowel pins 36 retained between bars 34. Dowel pins 36 are pinned by lock pin 37 so that the dowel pins do not rotate.

The roller bar segments 30 are pivotally connected to the end segments 32 by clevis pins 40 retained by cotter pin 41. Each arm 32 has a shoulder 32*b* which is adapted to engage a shoulder 34*b* on bar 34 to limit movement of the roller arm segments 30 toward the body 10. As will be more evident hereinafter, such shoulders 32*b* and 34*b* permit the arms 32 and 34 to assume a substantially parallel position relative to the body 10, but prevent it from going further inwardly. Mounted on each end segment 32 in a slot 41 is an arch spring 42 that biases the end segment 32 laterally away from the body 10. Thus, if the arms 32 and 34 are collapsed to a substantially parallel position relative to body 10 by reason of passage through a narrower section of well pipe, upon further passage to a larger diameter portion of the well pipe, the springs 42 urge the arms 32 and 34 out.

The roller bar segments 30 are biased laterally away from the body 10 by a pair of coil springs 44 around the body 10 between the movable collars 26 and the fixed collars 22 and 24. The coil springs 44 bias the movable collars 26 away from the stationary collars 151 and 24 thereby forcing the attached ends 32*a* of the end segments 32 together for biasing the roller bar segment 30 laterally away from the body 10. The travel of the movable collars away from fixed collars 151 and 24 is limited by two longitudinally spaced stops 46 mounted on the body 10. The stops 46 are horseshoe shaped and slide into grooves 49 in the body 10 and are held in place by set screws 51. The tension of the coil springs 44 is adjustable by threading the threaded collar 24 upwardly and downwardly on the threads at the upper end 10*a* of the body 10. The threaded collar 24 is locked in its desired position by abutment of locking collar 25 against collar 24.

In the preferred form of the invention, the stops 46 are positioned so as to permit the bar segments 30 to move outwardly from the tool body 10 so that the angle between the segments 30 and the arms 32 is about 45°. This angle could be increased but as the angle gets greater there is a risk that the centralizer would be difficult to collapse back down by restrictions in the well bore or pipe. By reason of such relatively large angle, the length of the tool is shorter than those in the prior art.

Figure 1:
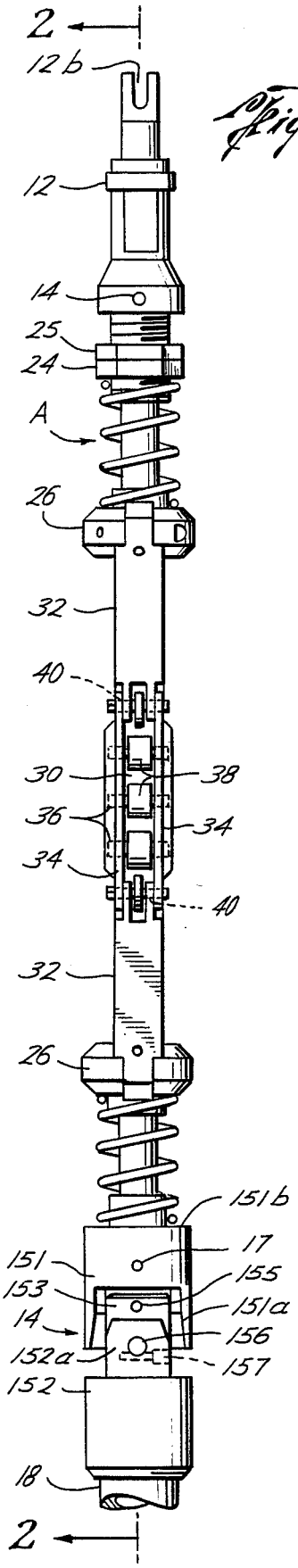
FIG. 1 is a plan view of the present invention.
Figure 2:
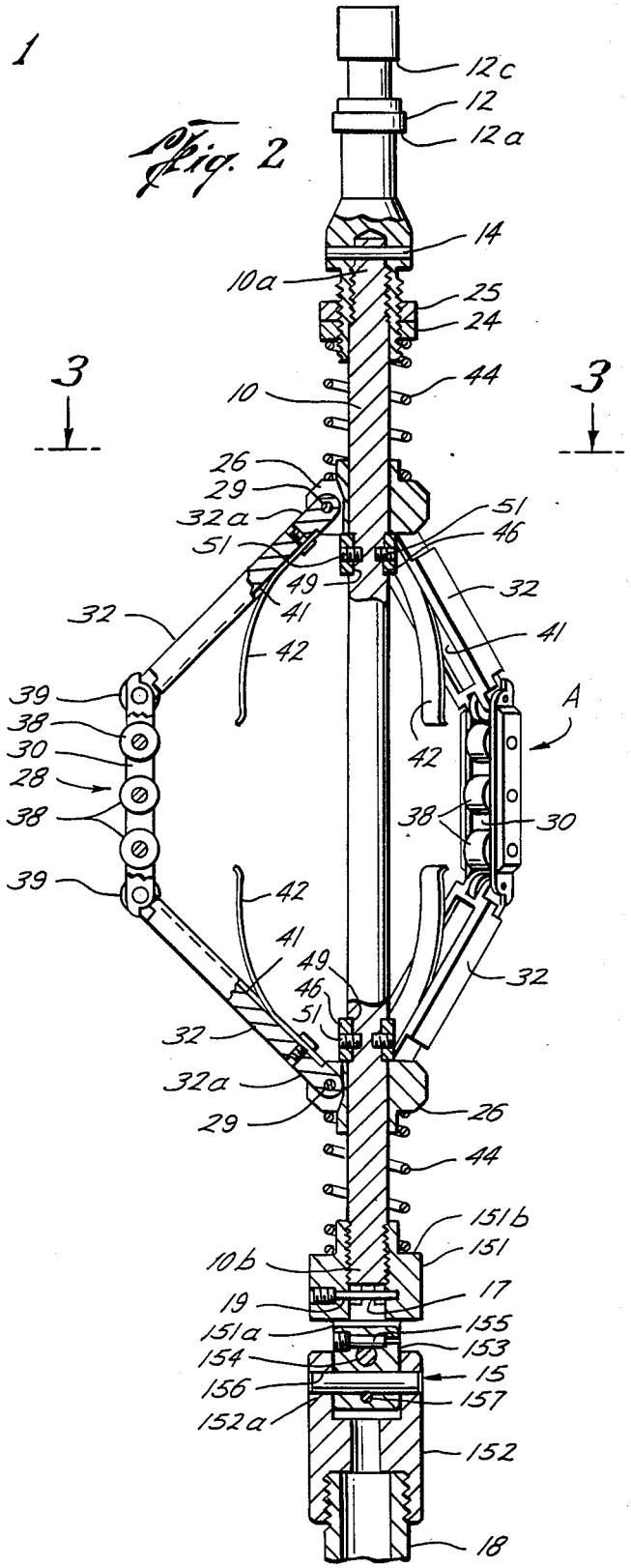
FIG. 2 is a cross-sectional view of the roller arm centralizer along line 2—2 of FIG. 1.
Figure 3:
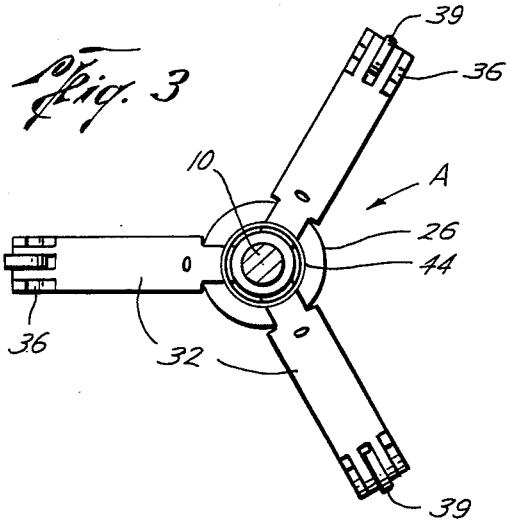
FIG. 3 is a cross-sectional view along line 3—3 of FIG. 2.

In the use of the centralizer A of this invention, it is mounted at the upper end 18 (FIG. 2) of a caliper tool (not shown) or any other tool and to a wire line 13 at its upper end (FIG. 1A) to center the calipering tool in a well pipe. As the centralizer A is lowered into a well pipe, the rollers 38 and 39 mounted on the roller bar segment 30 are forced laterally into contact with the internal wall of the well pipe by coil springs 44, thereby centering the apparatus A and the caliper or other tool connected therebelow. As the well pipe diameter varies, coil springs 44 bias the centering arms 28 to maintain the drill string at the center of the bore. When the roller arm centralizer encounters a narrower length of pipe or an abrupt change in pipe diameter, the engagement of the shoulders 32*b* and 34*b* prevents the roller bar segments 30 and the two attached end segments 32 from aligning along the body 10 in a position such that coil springs 44 would not be able to force the centralizer arms 28 laterally outwardly. For example, if such shoulders 32*b* and 34*b* were not provided, inward pivoting could occur at either the upper roller 39 or the lower roller 39 so that one of such rollers 39 moved inwardly towards the body 10 while the other roller 39 stayed in contact with the internal wall of the well pipe, resulting in a collapsed condition which could not be overcome by the springs 44 or 42. In such a situation, the tool would become unable to perform its centralizing function. The present invention avoids such a problem.

Arch springs 42 urge the spacers laterally away from the body 10 by augmenting the coil springs 44 outward biasing action as the centering arms 28 approach a position in alignment along the body 10.

Although the invention is described for centering a calipering tool mounted on a wire line for use in a well pipe, the invention is adaptable for use in centering other apparatus in a pipe, casing or open bore without departing from the spirit and scope of the invention.

It should be understood that the foregoing description and drawings of the invention are not intended to be limiting, but are only exemplary of the inventive features which are defined in the claims.

What is claimed is:

1. A roller arm centralizer for centering an oil well tool in a well bore, comprising:

an elongated body having ends adapted to allow said body to be mounted in a drill string;

a pair of stationary collars attached to said body adjacent opposite ends thereof;

a pair of movable collars mounted on said body adjacent opposite ends thereof between said stationary collars;

a plurality of centering arms, concentric with and spaced from each other about said elongated body, each comprising an intermediate roller bar segment and a pair of connector segments pivotally attached to the ends of said roller segment, each connector segment being pivotally connected at one end to a corresponding movable collar;

a plurality of pivot stop means between said roller bar segments and said connector segments for preventing said roller bars and corresponding connector bars from movement into alignment with said body;

first biasing means to bias said movable collars away from said corresponding fixed collars to move said connector segments with each roller bar segment toward each other for thereby urging said roller arm segments laterally away from said body; and second biasing means carried by each of said connector segments and of a length to contact the connector segment without contacting the intermediate roller bar segment to bias said connector segments away from said elongated body only when said connector segments approach alignment with said elongated body.

2. The roller arm centralizer of claim 1, wherein said first biasing means comprises a coil spring about said body, between a fixed collar and the corresponding movable collar.

3. The roller arm centralizer of claim 1, wherein one of said fixed collars is threadably mounted on said body to thereby permit adjustment of the tension of said first biasing means.

4. The roller arm centralizer of claim 1, further comprising a pair of stops attached to said elongated body to limit the movement of said movable collars away from said fixed collars.

5. The roller arm centralizer of claim 1 wherein said second biasing means comprises an arched spring attached to each of said connector segments.

6. The roller arm centralizer of claim 1 wherein said intermediate roller bar segment comprises;

a pair of bars; and a plurality of rollers mounted between said bars on pins.

7. The roller arm centralizer of claim 1 which further comprises a universal joint at one end of said elongated body and a fishing neck having provision to connect a wire line at the opposite end.

8. A device for centering a tool in a well pipe comprising:

an elongated body having ends adapted to allow said body to be mounted for running a tool in a well pipe;

a plurality of centering arms, each comprising an intermediate roller bar segment with rollers thereon adapted to engage the well pipe, and a pair of connector segments;

pivot means for pivotally interconnecting each roller bar segment with the pair of connector segments adjacent thereto;

stop means for limiting the relative movement of said roller bar segments and the corresponding pair of connector segments inwardly beyond substantially parallel alignment with said elongated body;

first biasing means comprising at least one spring exerting an axial force on said centering arms to urge them outwardly into engagement with the wall of the well pipe; and a plurality of second biasing means carried by said connector segments for engagement with said elongated body as said connector segments approach said elongated body for biasing said connector segments away from alignment therewith.

* * * * *